United States Patent [19]

Kubozono et al.

[11] Patent Number: 5,028,282

[45] Date of Patent: Jul. 2, 1991

[54] CU-NI-SN ALLOY WITH EXCELLENT FATIGUE PROPERTIES

[75] Inventors: Kenji Kubozono, Sagamihara; Kimio Hashizume; Teruo Nakanishi, both of Amagasaki, all of Japan

[73] Assignee: Mitsubishi Denki Kabushiki Kaisha, Tokyo, Japan

[21] Appl. No.: 462,352

[22] Filed: Jan. 3, 1990

Related U.S. Application Data

[63] Continuation of Ser. No. 206,710, Jun. 15, 1988, abandoned.

[30] Foreign Application Priority Data

Jun. 15, 1987 [JP] Japan ..... 62-148329

[51] Int. Cl.[5] ..... C22C 9/06

[52] U.S. Cl. ..... 148/412; 148/414; 420/473

[58] Field of Search ..... 148/412, 414, 12.7 C; 420/472, 473

[56] References Cited

U.S. PATENT DOCUMENTS

| | | | |
|---|---|---|---|
| 31,180 | 3/1983 | Plewes | 148/412 |
| 4,090,890 | 5/1978 | Plewes | 148/12.7 C |
| 4,142,918 | 3/1979 | Plewes | 148/12.7 C |
| 4,681,629 | 7/1987 | Reinshagen | 75/246 |
| 4,732,625 | 3/1988 | Liuak | 148/433 |

FOREIGN PATENT DOCUMENTS

| | | | |
|---|---|---|---|
| 2722 | 1/1980 | Japan | 148/12.7 C |
| 53625 | of 1981 | Japan . | |
| 70248 | 4/1982 | Japan | 148/414 |
| 43903 | of 1985 | Japan . | |

OTHER PUBLICATIONS

*Japanese Electronic Materials Society*, vol. 15, May 1983, pp. 13–18.

*Primary Examiner*—R. Dean
*Assistant Examiner*—George Wyszomierski
*Attorney, Agent, or Firm*—Oblon, Spivak, McClelland, Maier & Neustadt

[57] ABSTRACT

A Cu-Ni-Sn alloy with excellent fatigue properties comprising 6 to 25 wt % of Ni, 4 to 9 wt % of Sn, 0.04 to 5 wt % in total of at least one element selected from the following elements:

Zn . . . 0.03–4 wt %, Zr . . . 0.01–0.2 wt %,
Mn . . . 0.03–1.5 wt %, Fe . . . 0.03–0.7 wt %,
Mg . . . 0.03–0.5 wt %, P . . . 0.01–0.5 wt %,
Ti . . . 0.03–0.7 wt %, B . . . 0.001–0.1 wt %,
Cr . . . 0.03–0.7 wt %, Co . . . 0.01–0.5 wt %, and the rest being substantially Cu, and subjected, before final finish working, to heat treatment for structure arrangement at a temperature of 500° to 770° C., then to finish working of at most 50%, followed by age treatment at a temperature of 350° to 500° C. for 3 to 300 minutes.

2 Claims, No Drawings

CU-NI-SN ALLOY WITH EXCELLENT FATIGUE PROPERTIES

This application is a continuation of application Ser. No. 206,710, filed on June 15, 1988, now abandoned.

BACKGROUND OF THE INVENTION

1. Field of the Invention

The present invention relates to a copper alloy with excellent fatigue properties suitable for use in electric devices such as switches and relays to which repeated stress is applied.

2. Discussion of Background

Heretofore, it has been common to use beryllium copper (e.g., Japanese Industrial Standard (JIS) C1720) and phosphor bronze (e.g., JIS C5210, C5191, C5102) as materials for switches, relays and the like, which are used under repetitive stress.

The beryllium copper has the highest strength among copper alloys and excellent properties against repeated stress, so that it has been used as a material for high grade springs in, for example, microswitches. Whereas, the phosphor copper is low in cost and has fairly good fatigue properties, so that it has commonly been used as a material for general-purpose springs in switches, relays and the like.

However, the beryllium copper has a disadvantage of high cost because a component element, Be, is extremely expensive. Whereas, the phosphor copper is far behind the beryllium copper in respect of the fatigue properties though low in cost. Therefore, it has long been desired to have an intermediate material excellent in the fatigue properties and suitable in cost to fill the gap between the beryllium copper and the phosphor bronze.

Further, Cu-Ni-Sn alloys are known as alloys having age-hardening properties through the sprinodal decomposition (see, for example, Japanese Unexamined Patent Publication No. 147840/1980, Bulletin of the Japanese Electronic Materials Society Vol. 15, p13).

These documents disclose Cu-Ni-Sn alloys treated at a high temperature of higher than 800° C. for structure arrangement. Such structure arrangement causes the alloys to be treated in a single phase region.

Such conventional Cu-Ni-Sn alloys have excellent strength after the age-hardening, but they are not substantially different from the phosphor bronze in the fatigue properties. Thus, the conventional Cu-Ni-Sn alloys have a problem that they are not necessarily suitable for use in switches, relays and the like.

SUMMARY OF THE INVENTION

It is an object of the present invention to solve such a problem and provide a Cu-Ni-Sn alloy low in cost and excellent in fatigue properties without a drop of electric conductivity.

The Cu-Ni-Sn alloy with excellent fatigue properties of the present invention comprises 6 to 25% by weight of nickel (Ni), 4 to 9% by weight of tin (Sn), 0.04 to 5% by weight in total of at least one additive element selected from the following elements:

Zn. . . 0.03–4 wt %, Zr. . . 0.01–0.2 wt %,
Mn. . . 0.03–1.5 wt %, Fe. . . 0.03–0.7 wt %,
Mg. . . 0.03–0.5 wt %, P. . . 0.01–0.5 wt %,
Ti. . . 0.03–0.7 wt %, B. . . 0.001–0.1 wt %,
Cr. . . 0.03–0.7 wt %, Co. . . 0.01–0.5 wt %, and the rest being substantially copper (Cu), and has subjected, before final finish working, to heat treatment for structure arrangement at a temperature of 500° to 770° C., then to finish working of at most 50%, followed by age treatment at a temperature of 350° to 500° C. for 3 to 300 minutes.

DETAILED DESCRIPTION OF THE PREFERRED EMBODIMENTS

According to the present invention, very small amounts of additive elements such as Zn, Mn, Ti, etc. are added in the above-mentioned ranges to a Cu-Ni-Sn alloy having age-hardening properties, and the mixture is subjected to heat treatment for structure arrangement at 600° to 770° C. before final finish working, then to finish working of at most 50%, followed by age-hardening at 350° to 500° C.

The Cu-Ni-Sn alloy of the present invention provides a material relatively low in cost and excellent in fatigue properties. Namely, the alloy is consisted principally of relatively inexpensive base elements such as Cu, Ni and Sn, and excellent fatigue properties can be imported thereto without lowering the electric conductivity by the addition of small amounts of the additive elements in the above ranges, followed by the appropriate heat treatments.

The contents of Ni and Sn range from 6 to 25 wt % and from 4 to 9 wt %, respectively. The lower limits of 6 wt % for Ni and 4 wt % for Sn have been determined from the range in which the alloy has the age-hardening properties in relation to the relative contents of Ni and Sn. The upper limit of Ni is 25 wt % because Ni over 25 wt % brings about substantial reduction of the electric conductivity to such an extent that the alloy will be useless for application to switches, relays and the like. The upper limit of Sn is 9 wt % because Sn over 9 wt % results in deterioration of workability.

Among the additive elements, Zn, Mn, Mg, P and B are added to obtain an effect of deoxidization, and they are particularly effective for stabilization of the age-hardening properties. The contents of these elements have been determined in view of this effect. Ti, Cr, Zr, Fe and Co are added to improve the fatigue properties through micronization of crystalline particles and through strengthening of matrix by solution hardening and precipitation hardening. The upper limits of Ti, Cr, Zr, Fe and Co are determined so as not to affect the electric conductivity and the workability too much.

The total amount of the additive elements is 0.04 to 5 wt %. If the total amount is less than 0.04 wt %, no adequate effect of the addition is obtainable. If the total amount exceeds 5 wt %, the additive elements are over limit of solid solution of the alloy mainly containing Cu, Ni and Sn. The excessive addition of the additive elements over the solid solution limit does not contribute to the improvement on the properties of the alloy, but affects the workability.

The heat treatment for structure arrangement before the finish rolling is effected within a temperature range in which two or more phases having complex crystalline structures can appear for improvement of the fatigue properties. The temperature range for the heat treatment is 600° C. to 770° C. If the heat treatment is conducted below 600° C., subsequent working by plastic deformation will be difficult. On the other hand, if the temperature is over 770° C., solution of precipitation phase is promoted to reduce the effect for improvement of the fatigue properties. The age treatment is conducted to further improve the properties after the heat treatment for the aforementioned structure arrangement. For this purpose, the temperature range for the treatment is 350° to 500° C. The rate of the final finish working has been defined to be at most 50% in consideration of the workability after the heat treatment for the structure arrangement in the above-mentioned temperature range.

As mentioned above, the temperature range from 600° to 770° C. for the heat treatment for the structure arrangement is outside the range for complete solution of the alloy having the above composition, and is effective for the formation of two or more phases with complex crystalline structures. This differs from usual heat treatment of general age-hardened alloys and contributes to the improvement in the fatigue properties. The additive elements serve for further improvement of the properties.

Now, the present invention will be described in further detail with reference to Examples. However, it should be understood that the present invention is by no means restricted to such specific Examples.

EXAMPLES

There are shown in Table components and characteristic values of alloy samples according to the present invention and comparative alloy samples. Each sample was first heated for three minutes at a temperature for the structure arrangement treatment: sample No. 1 in a single phase region at 870° C.; and sample Nos. 2 to 10 in a two phase region at 700° C. or in a complexed phase region including more than two phases. After the structure arrangement treatment, the samples were finished in a thickness of 0.3 mm at a cold working rate of 12% and then aged for two hours at 400° C.

TABLE

| Sample No. | Components (wt %) Ni | Sn | Zn | Mn | Ti | Cr | Zr | Fe | Mg | P | B | Co | Cu | Hardness (Hr) | Conductivity (% IACS) | Fatigue strength N=$10^7$) (kgf/mm$^2$) | |
|---|---|---|---|---|---|---|---|---|---|---|---|---|---|---|---|---|---|
| 1 | 9.03 | 6.28 | — | — | — | — | — | — | — | — | — | — | the rest | 342 | 12 | 30 | Comparative alloy |
| 2 | 9.03 | 6.28 | — | — | — | — | — | — | — | — | — | — | the rest | 308 | 14 | 35.2 | Comparative alloy |
| 3 | 8.92 | 6.13 | 1.0 | 0.2 | — | — | — | — | 0.1 | 0.1 | 0.1 | — | the rest | 314 | 13 | 35.4 | Alloy of the present invention |
| 4 | 8.93 | 6.20 | — | — | 0.28 | — | — | — | — | — | — | — | the rest | 315 | 13 | 36.7 | Alloy of the present invention |
| 5 | 9.02 | 6.10 | — | — | — | 0.5 | 0.08 | 0.2 | — | — | — | — | the rest | 312 | 14 | 37.1 | Alloy of the present invention |
| 6 | 8.97 | 6.11 | — | — | — | — | — | — | — | 0.1 | — | 0.3 | the rest | 309 | 14 | 37.2 | Alloy of the present invention |
| 7 | 9.01 | 6.27 | — | — | — | — | — | 0.5 | — | — | 0.05 | — | the rest | 306 | 14 | 36.9 | Alloy of the present invention |
| 8 | 21.10 | 4.97 | — | — | 0.31 | — | — | — | — | — | — | — | the rest | 317 | 6 | 37.8 | Alloy of the present invention |
| 9 | 21.03 | 5.06 | 1.2 | 0.2 | — | — | — | — | 0.1 | 0.1 | 0.05 | — | the rest | 321 | 6 | 38.2 | Alloy of the present invention |
| 10 | 20.18 | 5.01 | — | — | 0.30 | 0.1 | — | 0.1 | — | — | — | — | the rest | 327 | 6 | 38.0 | Alloy of the present invention |
| 11 | Commercially available Be—Cu, C1720-1/4Ht | | | | | | | | | | | | | 386 | 25 | 38 | Comparative alloy |
| 12 | Commercially available P-Bronze, C5210-H | | | | | | | | | | | | | 203 | 11 | 27 | Comparative alloy |
| 13 | Commercially available P-Bronze, C5210-SH | | | | | | | | | | | | | 256 | 11 | 28 | Comparative alloy |

As seen from the results, sample Nos. 3 to 10, which include the additive elements of Zn, Mn, Ti, etc, within the specified ranges and to which the appropriate heat treatments have been applied, show remarkable improvement in the fatigue properties with no substantial reduction of the electric conductivity, being comparable to the beryllium copper, C1720 (sample No. 11). For example, when sample No. 1 (to which no additive element was added and no heat treatment was applied for improvement of the fatigue properties) is compared with sample Nos. 3 to 7 having substantially the same compositions except for the additional elements as to the fatigue strength after application of repeated stress of $10^7$ times, it is seen that sample Nos. 3 to 7 of the present invention have fatigue strength higher by 20 to 30% than sample No.1.

Sample Nos. 8 to 10 having higher Ni contents show that the hardness and the fatigue properties are improved as the Ni content increases. On the contrary, the electric conductivity tends to decrease as the Ni content increases. Therefore, it is clear that the upper limit of the Ni content should be limited in view of practical use.

The effect of the additive elements can be seen by comparing sample No. 3 of the present invention with sample No. 2 to which only the heat treatment is applied to improve the fatigue properties. There is little difference between their fatigue strength, which proves that the addition of the elements, Zn, Mn, Mg, P and B has no adverse effect on the fatigue properties. On the other hand, such elements serve as a deoxidizing agent at the time of casting operation and thus improve the castability of alloys. They are effective also to increase the strength to some extent. Thus, the addition of Zn, Mn, Mg, P and B is effective. However, the maximum amounts of these elements should be limited so that the addition does not adversely affect the electric conductivity and does not bring about the sensitivity to the stress corrosion cracking.

Further, when sample Nos. 4 to 7 of the present invention are compared with sample No. 2 of the comparative alloy, it is readily apparent that the additive elements, Ti, Cr, Zr, Fe and Co improve the fatigue properties. The upper limits of the elements have been determined in consideration of the electric conductivity.

From the results of the Examples, it may appear that the effect for improvement is not significant since the increases in the values of the fatigue strength are not remarkable. This is because the fatigue properties are evaluated by the fatigue strength at finite life, i.e., a stress magnitude or fatigue strength after the constant number of repetition of stress ($N=10^7$ times), which is a common evaluation measure for the fatigue properties. For example, sample No. 1 of the comparative alloy and sample No. 3 of the present invention show the fatigue strength of 30 and 35 kgf/mm$^2$, respectively. The degree of improvement in the fatigue strength is only 17% by this evaluation. To the contrary, if sample Nos. 1 and 3 are evaluated by mean break life (the number of times) at a constant stress magnitude, $\sigma a=40$ kgf/mm$^2$, the life of sample No. 3 is $4.1\times10^6$ times while that of sample No. 1 is $6.2\times10^5$ times. This means that sample No. 3 has break life seven times longer than sample No. 1. Thus, there is remarkable improvement in the fatigue properties assuring the reliability.

As described in the foregoing, the alloy according to the present invention is very effective in use under the repeated stress so that it may be used as a material for springs in switches, relays and the like. In addition, since the alloy of the present invention has excellent strength and a composite structure where in a matrix or first phase, a second phase is dispersed uniformly and finely, the alloy is also to use in the field requiring resistance to wear.

Accordingly, the present invention provides a Cu-Ni-Sn alloy excellent in fatigue properties and low in cost, without reduction of the electric conductivity.

What is claimed is:

1. A Cu-Ni-Sn alloy with excellent fatigue properties comprising 6 to 25 wt % of Ni, 4 to 9 wt % of Sn, 0.04 to 5 wt % in total of at least one element selected from the following elements:

Zn. . . 0.03–4 wt %, Zr. . . 0.01–0.2 wt %,
Mn. . . 0.03–1.5 wt %, Fe. . . 0.03–0.7 wt %,
Mg. . . 0.03–0.5 wt %, P. . . 0.01–0.5 wt %,
Ti. . . 0.03–0.7 wt %, B. . . 0.001–0.1 wt %,
Cr. . . 0.03–0.7 wt %, Co. . . 0.01–0.5 wt %, and the rest being substantially Cu, and having been subjected, before final finish working, to heat treatment for structure arrangement at a temperature of 500° to 770° C. effective for the formation of two or more phases in said alloy, then to finish working of at most 50%, followed by aging at a temperature of 350° to 500° C. for 3to 300 minutes.

2. An electric device to which repeated stress is applied, comprising the Cu-Ni-Sn alloy of claim 1.

* * * * *